US005533894A

United States Patent [19]

Capps

[11] Patent Number: 5,533,894

[45] Date of Patent: Jul. 9, 1996

[54] EQUINE DENTAL FLOAT

[75] Inventor: R. Scott Capps, Clatonia, Nebr.

[73] Assignee: World Wide Equine, Waverly, Nebr.

[21] Appl. No.: 298,849

[22] Filed: Aug. 31, 1994

Related U.S. Application Data

[63] Continuation-in-part of Ser. No. 12,756, Sep. 8, 1993, Pat. No. Des. 357,317.

[51] Int. Cl.[6] ..... A61D 5/00

[52] U.S. Cl. ..... 433/1; 168/48.1; 407/29.14; 119/600

[58] Field of Search ..... 433/1, 142, 144; 132/76.4, 76.6, 75.4; 168/48.1; 29/78, 79, 80

[56] References Cited

U.S. PATENT DOCUMENTS

| | | | |
|---|---|---|---|
| D. 30,996 | 6/1899 | Pegg | D8/90 |
| D. 214,238 | 5/1969 | Bender | D24/152 X |
| 309,973 | 12/1884 | Müller | 29/79 |
| D. 348,598 | 7/1994 | Friel, Jr. et al. | D8/90 |
| 545,739 | 9/1895 | Shaw | 168/48.1 |
| 669,744 | 3/1901 | Ellis | 433/1 |
| 769,340 | 9/1904 | Fleming | 433/1 |
| 855,007 | 4/1907 | Johnson | 433/1 |
| 858,171 | 6/1907 | Getaz | 29/79 |
| 927,249 | 7/1909 | Kiefer | 433/1 |
| 1,006,820 | 10/1911 | Adams | 29/80 |
| 1,032,897 | 7/1912 | Hamilton | D24/147 X |
| 1,066,340 | 7/1913 | Thomas | D8/90 |
| 1,081,495 | 12/1913 | Dunn | 433/1 |
| 1,347,933 | 7/1920 | Brix | 433/1 |
| 2,058,912 | 10/1936 | Reid | 29/78 |

FOREIGN PATENT DOCUMENTS

| | | | |
|---|---|---|---|
| 541742 | 12/1931 | Germany | 29/79 |

*Primary Examiner*—Cary E. O'Connor
*Attorney, Agent, or Firm*—Zarley, McKee, Thomte, Voorhees & Sease; Mark D. Frederiksen

[57] ABSTRACT

An equine dental float includes a handle with a head at one end, the head including a trough like structure with a plurality of individual teeth mounted in the trough. A pin mounted through an aperture in each of the plurality of teeth aligns the teeth and removably connects the teeth within the trough. Each tooth is polygonal in shape and has a plurality of cutting edges, with one of the cutting edges of each tooth projecting upwardly out of the trough to form a filing surface.

7 Claims, 3 Drawing Sheets

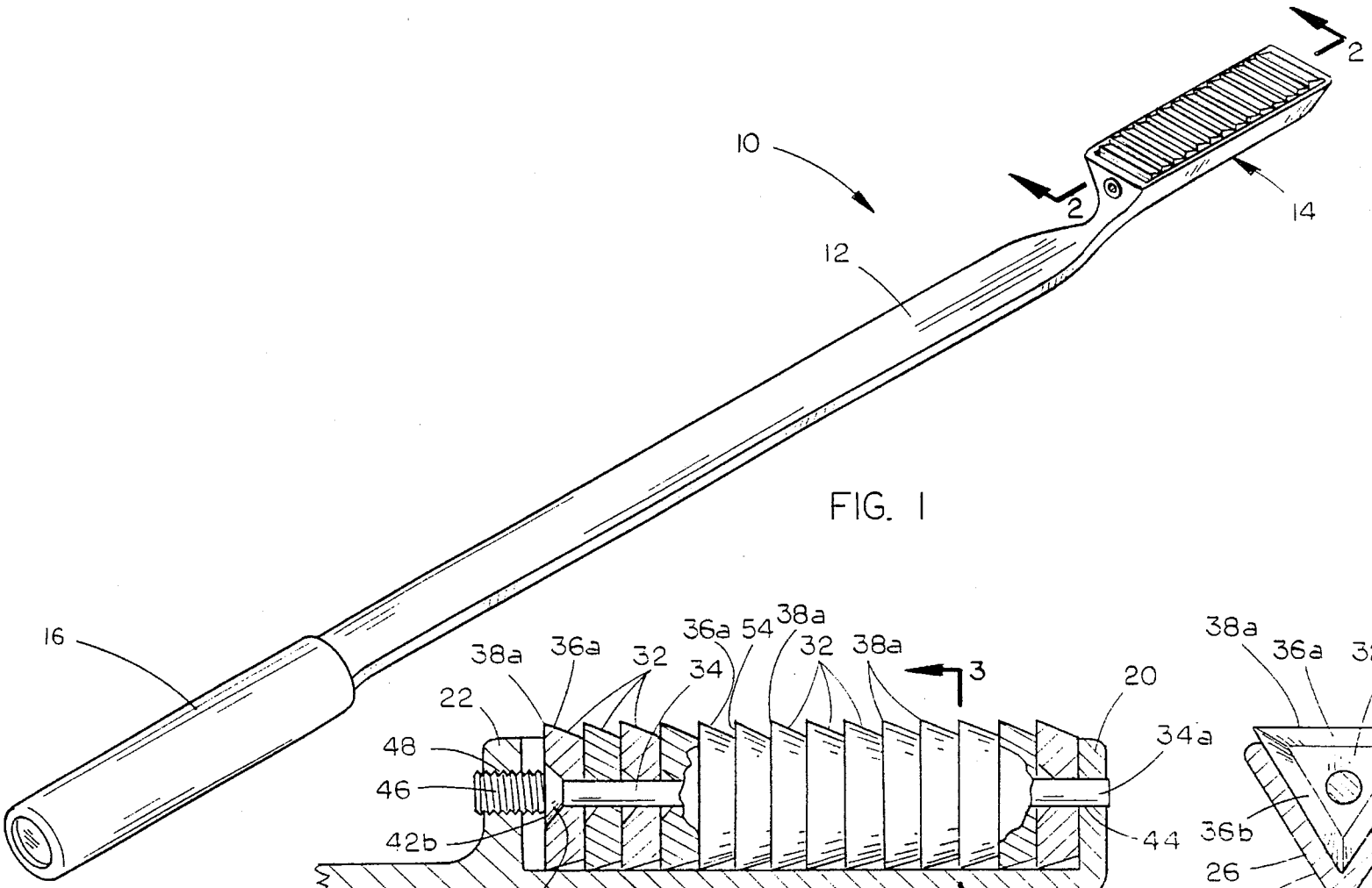
FIG. 1
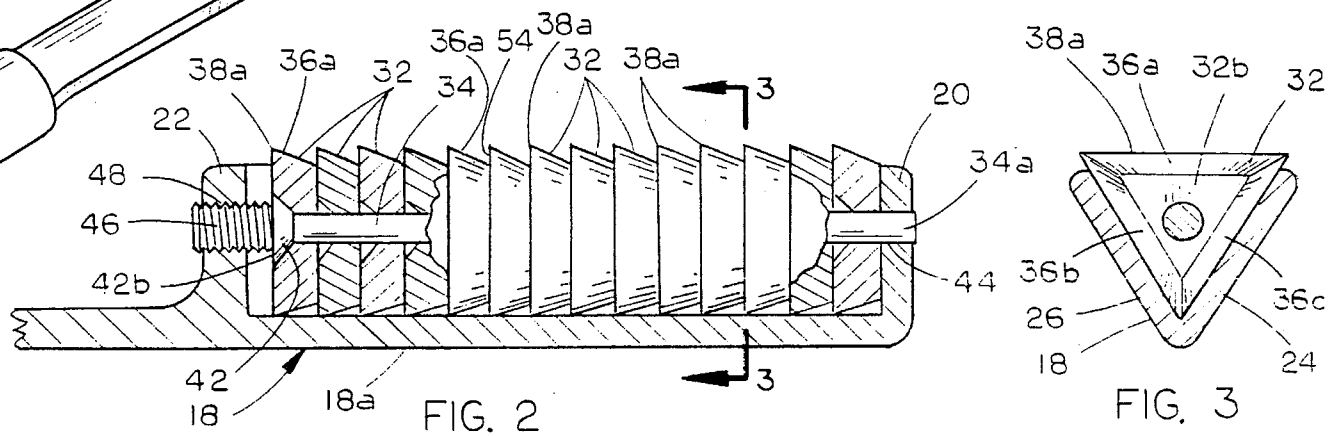
FIG. 2
FIG. 3

EQUINE DENTAL FLOAT

CROSS-REFERENCE TO RELATED APPLICATION

This is a continuation-in-part application of Ser. No. 29/012,756 filed Sep. 8, 1993, now U.S. Design Pat. No. D357317.

TECHNICAL FIELD

The present invention relates generally to files, and more particularly to an improved equine dental float.

BACKGROUND OF THE INVENTION

Horses teeth are continuously growing, and it is typically necessary to periodically file projecting edges of the teeth. Without "floating" the horses teeth will grow to a point where the horse will have difficulty in chewing without injury to the mouth.

The instrument utilized to file the horses teeth is called a "float" with a float head having carbide grit thereon, much like sandpaper. The size of the grit will determine the coarseness of the float head.

The most common problem associated with equine floats is the length of time which the float head will retain sufficient grit for effective floating. As with sandpaper, the grit will eventually wear off of the float head until the float must be replaced or rebuilt.

SUMMARY OF THE INVENTION

It is therefore a general object of the present invention to provide an improved equine dental float.

Another object of the present invention is to provide a float with removable and replaceable individual cutting teeth.

Yet another object is to provide a float head with individual cutting teeth having a plurality of separate cutting surfaces, permitting rotation and reuse of each cutting tooth.

Still another object is to provide a dental float with easily replaceable teeth and a plurality of identical teeth reducing the cost of manufacture.

These and other objects will be apparent to those skilled in the art.

The equine dental float of the present invention includes a handle with a head at one end, the head including a trough like structure with a plurality of individual teeth mounted in the trough. A pin mounted through an aperture in each of the plurality of teeth aligns the teeth and removably connects the teeth within the trough. Each tooth is polygonal in shape and has a plurality of cutting edges, with one of the cutting edges of each tooth projecting upwardly out of the trough to form a filing surface.

BRIEF DESCRIPTION OF THE DRAWINGS

FIG. 1 is a perspective view of the float of the present invention;

FIG. 2 is a sectional view taken at lines 2—2 in FIG. 1;

FIG. 3 is a sectional view taken at lines 3—3 in FIG. 2;

DESCRIPTION OF THE PREFERRED EMBODIMENT

Figure 4:
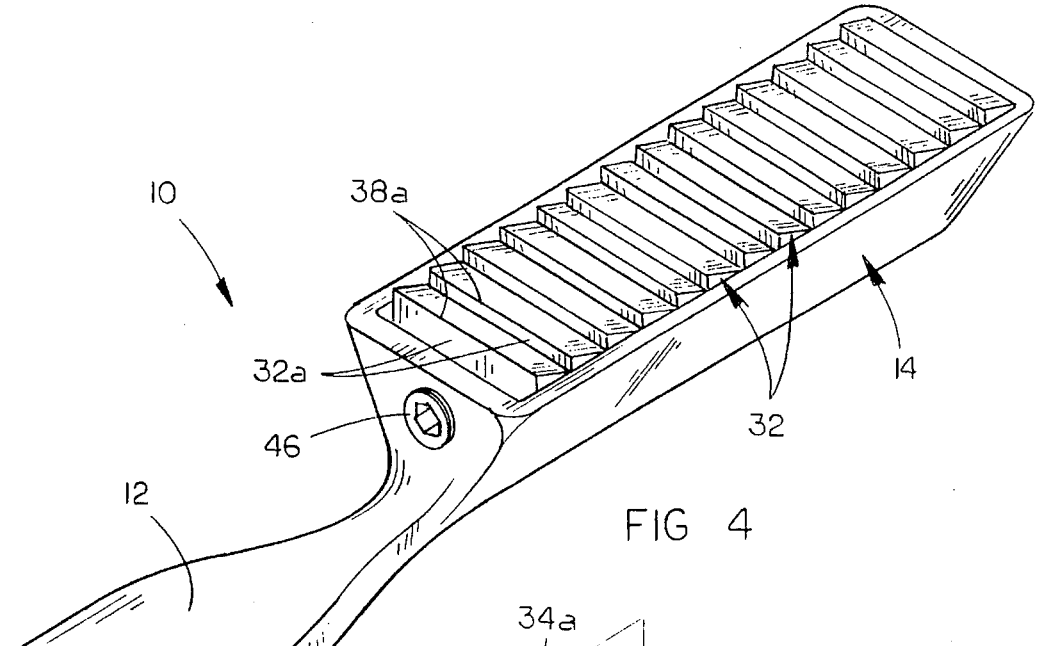
FIG. 4 is an enlarged perspective view of the float head of the float of FIG. 1.

Referring now to the drawings, in which similar or corresponding parts are identified with the same reference numeral, and more particularly to FIG. 1, the equine dental float of the present invention is designated generally at 10 and includes an elongated handle 12 with a float head 14 mounted at a forward end, and a hand grip 16 mounted at a rearward end.

Figure 5:
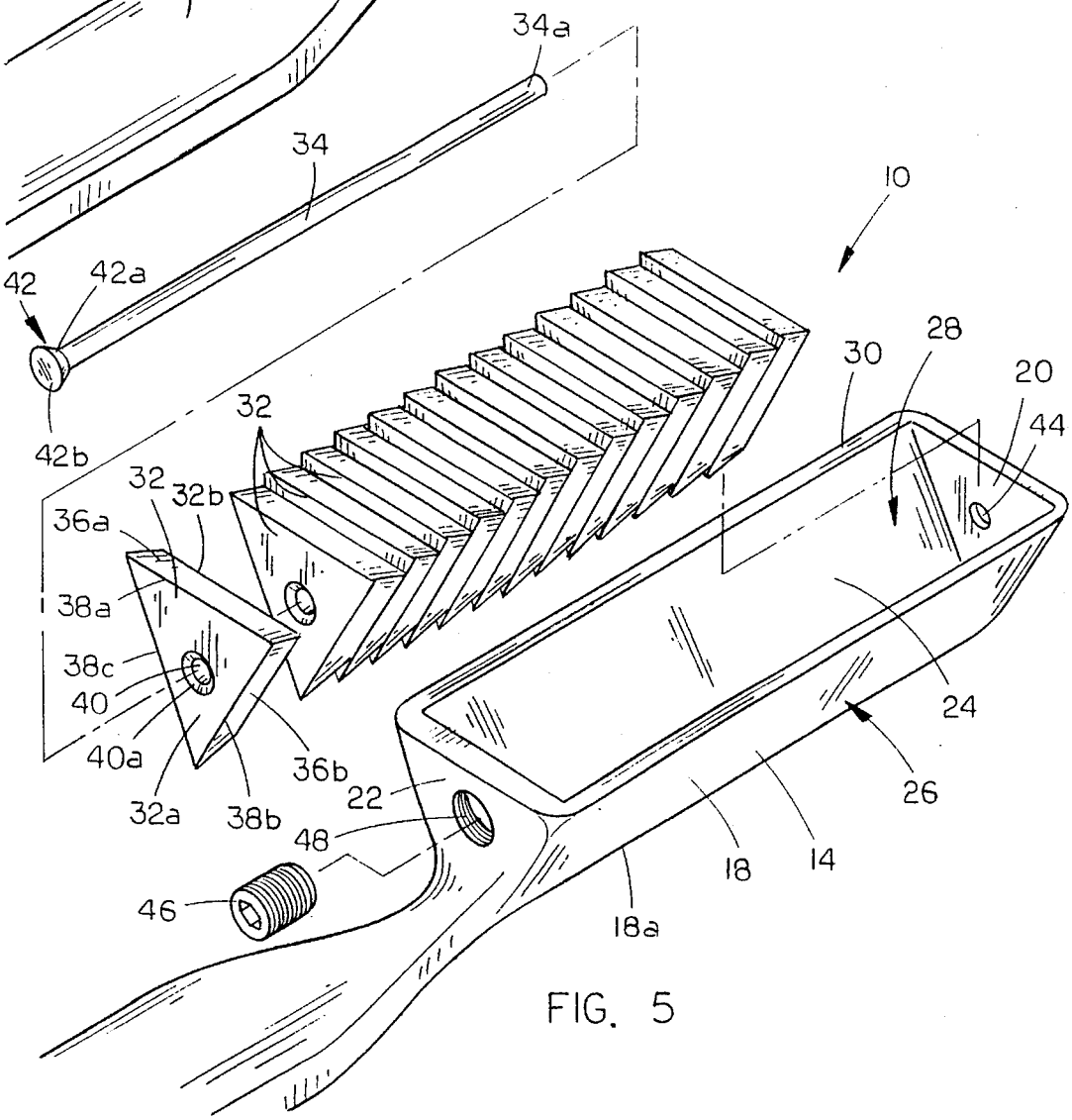
FIG. 5 is an exploded perspective view of the float head shown in FIG. 4.

Referring now to FIG. 5, float head 14 includes a trough 18 having a rearward end wall 20, forward end wall 22, opposing longitudinal side walls 24 and 26 and an interior cavity 28. The upper ends of end walls 20 and 22, and side walls 24 and 26 forms an upper perimeter edge 30 continuously along the walls. Side walls 24 and 26 are sloped towards one another and have a common lower edge 18*a*. A plurality of individual and triangular shaped teeth 32 are interconnected by an elongated pin 34 and received within the correspondingly shaped trough cavity 28.

Because each tooth 32 is preferably identical, only one tooth will be described in detail herein. Tooth 32 includes a forward face 32*a* and a rearward face 32*b* (shown in FIG. 3). Preferably, tooth 32 is in the shape of an equilateral triangle with three identical side walls 36*a*, 36*b* and 36*c* extending from forward face 32*a* to rearward face 32*b*. Rearward face 32*b* has a smaller area than forward face 32*a* such that side walls 36*a*, 36*b* and 36*c* slope rearwardly from forward face 32*a* to rearward face 32*b* (as shown more clearly in FIG. 2). The juncture between each side wall 36*a*, 36*b* and 36*c* and forward face 32*a* forms three cutting edges 38*a*, 38*b* and 38*c* along each of the edges of forward face 32*a*.

An aperture 40 is centered in forward face 32*a* and extends from forward face 32*a* to rearward face 32*b* to receive pin 34. Aperture 40 has a counter sunk forward surface 40*a* to receive the counter sunk surface 42*a* of pin head 42 therein. The rearward end 34*a* of pin 34 is journaled through an aperture 44 in rearward end wall 20, once journaled through apertures 40 in teeth 32, to retain teeth 32 aligned within trough cavity 28.

A set screw 46 is threaded through a threaded aperture 48 in forward end wall 22 of trough 18, and is aligned with aperture 44 to directly contact the flat bearing surface 42*b* on pin head 42, as shown in FIG. 2. Thus, clockwise rotation of set screw 46 will impose a biasing force on pin head 42 to force the pin into contact with teeth 32 and bias the teeth against rearward end wall 20 of trough 18.

Because trough 18 has a generally V-shaped cross-section, as shown in FIG. 3, each tooth 32 will be aligned with one another such that each cutting edge 38*a* is parallel with one another, all cutting edges 38*a* line within the same horizontal plane.

Figure 6:
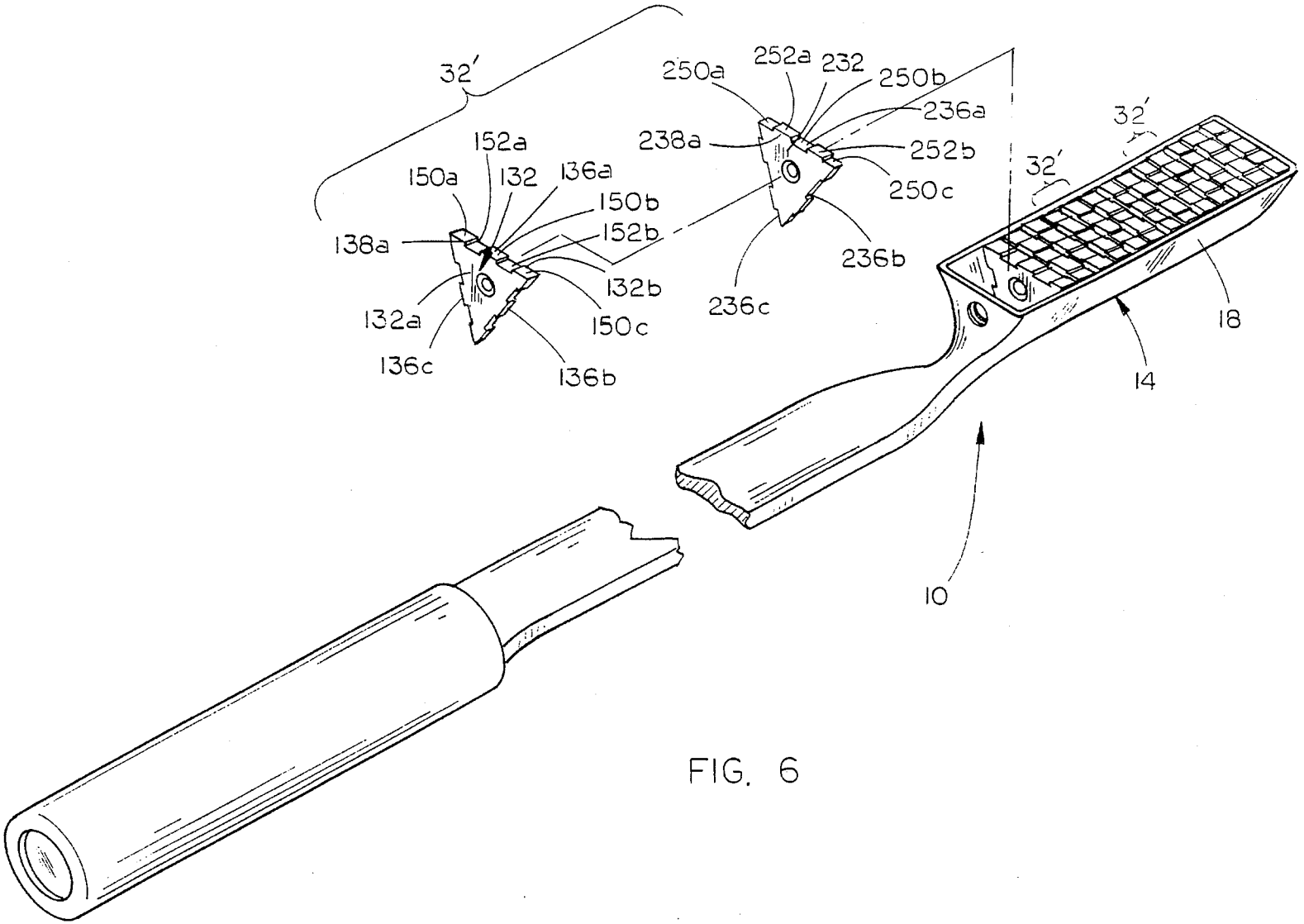
FIG. 6 is a partially exploded perspective view of a second embodiment of the invention.

A second embodiment of the teeth for float 10 are shown in FIG. 6, and includes pairs of teeth 32' including a forward tooth 132 and a rearward tooth 232 in each pair. Each forward tooth 132 is triangular in shape and has three side walls 136*a*, 136*b* and 136*c* extending at a sloped rearward angle from the forward face 132*a* to the rearward face 132*b*. Each side wall 136*a*, 136*b* and 136*c* includes three raised surfaces 150*a*, 150*b* and 150*c* separated by two depressed surfaces 152*a* and 152*b*, such that cutting edge 138*a* includes raised portions and depressed portions.

A second rearward tooth 232 is provided to correspond with forward tooth 132, but with side walls 236*a*, 236*b* and 236*c* having raised portions 252*a* and 152*b* aligned with depressed portions 152*a* and 152*b* of tooth 32'. Similarly, rearward tooth 232 has depressed portions 250*a*, 250*b* and 250*c* which are aligned with raised portions 150*a*, 150*b* and 150*c* of tooth 132. This alternating raised and depressed portion on the cutting edges 138*a* and 238*a* provides a "grit" or "bite" to the set of teeth 132 and 232 which is finer than the "grit" of teeth 32 shown in FIG. 4. By providing the pair of teeth 32' with a greater number of raised and depressed portions, the "grit" or coarseness of the float head can be made finer, thereby removing less material on each pass. Similarly, the coarseness of the float head produced by teeth 32 may be adjusted by increasing the area of the rearward face 32*b*, so as to decrease the amount of slope between the forward face and rearward face. This in turn reduces the "bite" 54, the distance between each cutting edge 38*a* and the juncture between side wall 36*a* of the next adjacent tooth 32, as shown in FIG. 2.

In operation, the desired set of teeth 32 are chosen and journaled on pin 34. While teeth 32 are shown as freely rotatably on pin 34, it is envisioned that other configurations of the cutting teeth may be journaled on pin 34 to prevent rotation, such as by slot and key. Pin 34, with a set of teeth 32 journaled thereon, is then inserted within trough cavity 28 with the rearward end 34*a* of pin 34 journaled in aperture 44. Set screw 46 is threaded through aperture 48 and into contact with pin head 42 to secure the teeth in position.

If one or more of the teeth become worn, the set of teeth 32 may be removed from trough 18 and one or more individual teeth rotated to position a new cutting edge 38*b* or 38*c*, or completely replaced with a new tooth. In addition, an entirely new set of teeth 32 or 32' or 132 may be interchanged as desired in the float head 14.

Whereas the invention has been shown and described in connection with the preferred embodiments thereof, it should be understood that many modifications, substitutions and additions may be made which are within the intended broad scope of the appended claims. For example, polygonal shapes other than a triangle may be used for each tooth, thereby providing different numbers of cutting edges for the teeth.

I claim:

1. A filing apparatus, comprising:

a handle having a file head mounted on one end thereof;

said file head including a trough having forward and rearward end walls, opposing longitudinal side walls, a bottom, an open upper end and an interior cavity bounded by the end walls, side walls and bottom;

a plurality of individual cutting teeth removably mounted in said trough cavity with a cutting edge of each tooth projecting upwardly beyond upper edges of the side walls and end walls to form a filing surface;

each said tooth including a plate member having a forward face, rearward face, and a plurality of side walls extending between the forward and rearward faces to form a tooth thickness, the juncture of each side wall with the forward face forming said cutting edge on each side wall forward edge;

said trough side walls and bottom being configured to receive said teeth and prevent rotation of said teeth on a pin while permitting independent removal of individual teeth vertically from the trough;

mounting means for removably mounting each tooth with one of said plurality of cutting edges projecting upwardly out of said cavity.

2. The filing apparatus of claim 1, wherein said forward face has the shape of a regular polygon, and the rearward face has the same shape as the forward face.

3. The filing apparatus of claim 1, wherein the juncture of each side wall with the rearward face of each tooth forms a rearward edge, and wherein each side wall slopes rearwardly from the cutting edge to the rearward edge.

4. The filing apparatus of claim 1, wherein each said tooth includes an aperture through the thickness thereof, said apertures centered in the forward and rearward faces, and wherein said mounting means includes a pin journaled through the apertures in said plurality of teeth with projecting forward and rearward ends of said pin removably connected to said trough forward and rearward end walls.

5. The filing apparatus of claim 1, wherein each tooth has a generally triangular forward face and wherein said trough side walls are connected at a lower edge to form a V-shape for receiving said triangular shape of the teeth.

6. The filing apparatus of claim 1, wherein each said tooth side wall includes a plurality of alternating raised and depressed surfaces, thereby forming raised and depressed portions on each said cutting edge.

7. The filing apparatus of claim 6, wherein each tooth is arranged in the trough with a cutting edge depressed portion adjacent an adjacent tooth cutting edge raised portion, and with a cutting edge raised portion adjacent an adjacent tooth cutting edge depressed portion, to form alternating raised and depressed cutting edge portions both laterally and longitudinally along a filing surface.

* * * * *